United States Patent [19]

Patzer, II

[11] 4,238,315

[45] Dec. 9, 1980

[54] RECOVERY OF OIL FROM OIL SHALE

[75] Inventor: John F. Patzer, II, Pittsburgh, Pa.

[73] Assignee: Gulf Research & Development Company, Pittsburgh, Pa.

[21] Appl. No.: 956,394

[22] Filed: Oct. 31, 1978

[51] Int. Cl.[2] ..... C10G 1/04

[52] U.S. Cl. ..... 208/11 LE

[58] Field of Search ..... 208/11 LE

[56] References Cited

U.S. PATENT DOCUMENTS

| | | | |
|---|---|---|---|
| 2,487,788 | 11/1949 | Buchan | 208/11 LE |
| 2,601,257 | 6/1952 | Buchan | 208/11 LE |
| 2,847,306 | 8/1958 | Stewart et al. | 208/11 LE |

*Primary Examiner*—Herbert Levine

[57] ABSTRACT

A process for recovering oil from oil shale containing kerogen which comprises bringing a mixture of oil shale and solvent to a temperature in the range of about 385° to about 440° C. in a time period of less than about 10 minutes, maintaining said mixture at a temperature in the range of about 385° to about 440° C. and a pressure in the range of about 250 to about 2000 pounds per square inch gauge (about 1.72 MPa to about 13.8 MPa) for a period of about 20 minutes to about two hours and thereafter recovering the resulting oil.

14 Claims, No Drawings

RECOVERY OF OIL FROM OIL SHALE

BACKGROUND OF THE INVENTION

1. Field of the Invention

This invention relates to a new and useful process for recovering oil from oil shale containing kerogen, a solid organic, primarily hydrocarbon, material having a high molecular weight, i.e., greater than about 3,000 grams per mol, which comprises about 10 to about 30 percent by weight of oil shale. The percentage recovery, as oil, of the organic matter originally present in the oil shale is low by most methods known in the art. Even the best operations result in relative high conversion of kerogen to carbon and permanent gases, which are of low economic value compared to liquid fuels. Consequently, a need exists for a simple process for recovering oil from oil shale which results in high yields of liquid product. Accordingly, the present invention provides a higher yield of liquid product by a process for recovering oil from oil shale containing kerogen which comprises bringing a mixture of oil shale and solvent to a temperature in the range of about 385° to about 440° C. in a time period of less than about 10 minutes, maintaining said mixture at a temperature in the range of about 385° to about 440° C. and a pressure in the range of about 250 to about 2000 pounds per square inch gauge (about 1.72 MPa to about 13.8 MPa) for a period of about 20 minutes to about two hours and thereafter recovering the resulting oil.

2. Description of the Prior Art

Hampton in U.S. Pat. No. 1,778,515 states that it is old to subject a bituminiferous material, such as oil shale, to the digestive action of an oil bath to recover oil from oil shale. He states that increased yields of oil can be obtained by mixing oil shale of one-half inch mesh with a heavy oil, which may be preheated, heating the resulting mixture gradually to a temperature of 300° to 400° F. (144° to 204° C.), grinding the shale in the heated mixture until 60 percent or more thereof will pass 200 mesh, and then heating the ground mixture, most desirably suddenly, to a materially high temperature in the range of about 600° to about 700° F. (316° C. to about 371° C.). Hampton considers the possibility of feeding dry pulverized shale, without any accompanying oil, in controllable amounts into a hot digestion bath, but advises against the same because of technical difficulties.

SUMMARY OF THE INVENTION

I have discovered a process for recovering oil from oil shale containing kerogen which comprises bringing a mixture of oil shale and solvent to a temperature in the range of about 385° to about 440° C. in a time period of less than about 10 minutes, maintaining said mixture at a temperature in the range of about 385° to about 440° C. and a pressure in the range of about 250 to about 2000 pounds per square inch gauge (about 1.72 MPa to about 13.8 MPa) for a period of about 20 minutes to about two hours and thereafter recovering the resulting oil.

DETAILED DESCRIPTION OF THE PROCESS

Any oil shale containing kerogen can be used in the invention herein. Generally, the shale is pulverized. For example, the shale can have a mesh size of at least about 10 but not in excess of about 400 using a U.S. Standard sieve, preferably at least about 20 but not in excess of about 200. The shale used in the examples herein came from shale deposits in the Western States of the United States, especially the States of Colorado and Wyoming. It is often referred to as Green River oil shale, and a description of its typical composition is reported by Stanfield, K. E., Frost, I. C., McAuley, W. S. and Smith, H. N. in Bureau of Mines Report of Investigations number 4825, 1951 entitled "Properties of Colorado Oil Shales", and also by Smith, John Ward in Bureau of Mines Report of Investigations number 5725, 1961 entitled "Ultimate Composition of Organic Material in Green River Oil Shale". However, this process is also applicable to oil shales from other areas, such as Chattanooga shale from Tennessee.

Any organic solvent, or a mixture of solvents in which the product oil is soluble, can be employed in the present invention. Preferably, any organic solvent or a mixture of organic solvents, which is a liquid under reaction conditions, most preferably a hydrocarbon solvent or a mixture of hydrocarbon solvents, which is a liquid under reaction conditions, can be employed herein. The boiling point at ambient pressure, that is, about 15 pounds per square inch absolute (0.1 MPa), of the solvent is at least about 80° C., preferably at least about 200° C., and is no higher than about 400° C., preferably no higher than about 350° C. Examples of organic solvents can include aromatics, such as benzene, 1-methylnaphthalene, phenol, quinone and quinoline; hydroaromatics, such as tetralin, hydrophenanthrenes and hydroanthracenes; aliphatics, such as hexane, cyclohexane, decane, cetane and decalin; alcohols, such as isopropanol and ethylene glycol; ketones, such as methyl ethyl ketone; and mixtures of organic compounds, such as product oil, shale oil, anthracene oil, diesel oil and coal liquids.

The mixture of oil shale and solvent to be treated herein can be obtained in any convenient manner, for example, by adding oil shale to solvent or solvent to oil shale or by bringing the two simultaneously in contact with each other. A solvent to shale weight/weight ratio (w/w) of at least about 1.25:1, preferably at least about 1.5:1 must be employed in order to obtain maximum oil yields. The upper limit of the solvent to shale ratio is not critical and is determined by economics of the operation and capability of the equipment, but can be, for example, no greater than about 4:1, preferably no greater than about 2:1. What is critical herein, however, is the bringing of the mixture to a temperature in the range of about 385° to about 440° C., preferably about 400° to about 420° C., in a time period of about two to about 10 minutes, preferably about three to about five minutes. Such heating can be carried out in any suitable manner, for example, by bringing together oil shale and solvent, with the solvent being at a sufficiently high temperature to obtain the desired temperature level, or by external means. In a preferred embodiment hot solvent is brought into contact with shale which is at a lower temperature. I have found that when the mixture of oil shale and solvent is thereafter heated, as hereinafter defined, to recover oil from said oil shale but is not heated to the defined temperature level within the defined time period, greatly reduced oil yields are obtained from said oil shale.

Once the mixture of oil shale and solvent defined above is raised to the defined temperature level within the defined time period, the mixture is maintained at a temperature of about 385° to about 440° C., preferably about 400° to about 420° C., and a pressure of about 250 to about 2000 pounds per square inch gauge (about 1.72 to about 13.8 MPa), preferably about 500 to about 1200 pounds per square inch gauge (about 3.45 to about 8.27 MPa) for a period of about 20 minutes to about two hours, preferably about 50 minutes to about 80 minutes. At the end of such time the resulting shale oil is recovered from the spent shale in any suitable manner. For example, the reactor contents can be brought to ambient temperature and ambient pressure and the shale oil, including solvent, can be separated from the spent shale by conventional means, for example, by filtration, settling or centrifuging. The oil and solvent mixture can then be sent to a fractionator to effect separation and the solvent can be recycled to the process. The process defined herein results in a heavy oil having a boiling point in excess of about 220° C. at ambient pressure, with only trace amounts of products boiling below 220° C.

Oil yield is the yield of liquid product in terms of Fischer Assay oil yield. The Fischer Assay oil yield is the yield of oil, in terms of gallons per ton, which is obtained from laboratory-scale retorting at 482° C. The oil yield, in percent Fischer Assay, is the recovered hydrocarbons divided by the Fischer Assay oil yield multiplied by 100.

The results obtained herein are most unusual, in that not only are the oil yields unexpectedly high, almost quantative, but the amounts of gases produced are negligible. Kerogen is rich in hydrogen and easily loses hydrogen at high temperatures. However, in the present process little or no hydrogen, or other gases, are produced. At the same time little or no solid carbonaceous materials are formed.

DESCRIPTION OF PREFERRED EMBODIMENTS

The process claimed herein will be further described with reference to experimental data. The following procedure was employed in each of Runs Nos. 1 to 11. An empty one-liter, stirred autoclave was electrically heated to the desired reaction temperature and held at said temperature for 30 minutes. At the end of this time 20×30 mesh shale particles, which were at ambient temperature, were introduced into the autoclave over a period of 30 seconds to one minute. Immediately after the introduction of the oil shale in the autoclave there was introduced therein hot process solvent (tetralin), which was at a temperature 10° C. higher than the autoclave. The autoclave was immediately sealed and pressured with nitrogen to a desired initial pressure. In each case the time required for the mixture of oil shale and solvent to reach reaction temprature was about three to five minutes. The mixture was then maintained at reaction temperature for a specified time, during which time a final, higher pressure level was reached. At the end of the reaction period the autoclave contents were quenched to ambient temperature and subsequently depressurized. The reactor effluent was then filtered and the filter cake rinsed with toluene. The filtrate was distilled under 200 mm Hg vacuum to an end point of 220° C. The toluene wash was also distilled under 200 mm Hg vacuum to a 220° C. end point. The residue from the distillation was termed recovered oil. The procedure employed in Run No. 12 differed over the previous runs in that oil shale and solvent (tetralin) at ambient temperature were introduced separately into the autoclave prior to heating. The autoclave was then heated to reaction temperature, immediately thereafter pressured to the desired pressure level with nitrogen and finally heated at reaction temperature and pressure. Recovery of oil was as in the previous runs.

The data obtained in Runs Nos. 1 to 4 are summarized below in Table I.

TABLE I

| Run No. | 1 | 2 | 3 | 4 |
|---|---|---|---|---|
| Reaction Temperature, °C. | 399 | 399 | 399 | 399 |
| Time Required for Mixture to Reach Reaction Temperature, Minutes | 3–5 | 3–5 | 3–5 | 3–5 |
| Initial Pressure, Pounds Per Square Inch Gauge (MPa) | 750 (5.17) | 750 (5.17) | 750 (5.17) | 750 (5.17) |
| Final Pressure, Pounds Per Square Inch Gauge (MPa) | 1080 (7.44) | 950 (6.55) | 1100 (7.58) | 1130 (7.79) |
| Reaction Time, Minutes | 10 | 25 | 55 | 115 |
| Solvent/Shale Ratio (Gram/Gram) | 1.5:1 | 1.5:1 | 1.5:1 | 1.5:1 |
| Oil Yield, Percent Fischer Assay | 73 | 111 | 128 | 146 |

The above runs show the effect of reaction time of the solvent-shale mixture at reaction temperature upon oil yield. Excellent oil yields obtained herein are always at least about 110 percent Fischer Assay, generally about 120 to about 146 percent Fischer Assay. Thus, in each of Runs Nos. 2 to 4, wherein the reaction time was within the defined range, excellent oil yields were obtained. As reaction time was increased so were the oil yields. However, as Run No. 4 shows it is not necessary to operate at higher reaction times, for substantially all of the oil has already been recovered. Referring to Run No. 1, it can be seen that at reaction times below 20 minutes undesirably low oil yields are obtained.

The data obtained in Runs Nos. 5 and 6 are summarized below in Table II. Included for reference purposes are the data for Run No. 3.

TABLE II

| Run No. | 5 | 6 | 3 |
|---|---|---|---|
| Reaction Temperature, °C. | 343 | 371 | 399 |
| Time Required for Mixture to Reach Reaction Temperature, Minutes | 3–5 | 3–5 | 3–5 |
| Initial Pressure, Pounds Per Square Inch Gauge (MPa) | 750 (5.17) | 750 (5.17) | 750 (5.17) |
| Final Pressure, Pounds Per Square Inch Gauge (MPa) | 910 (6.27) | 855 (5.89) | 1100 (7.58) |
| Reaction Time, Minutes | 55 | 55 | 55 |
| Solvent/Shale Ratio (Gram/Gram) | 1.5:1 | 1.5:1 | 1.5:1 |
| Oil Yield, Percent Fischer Assay | 69 | 87 | 128 |

Runs Nos. 5 and 6 in Table II show that when the reaction temperature is below about 385° C. unacceptably low oil yields are obtained. However, temperatures in excess of about 440° C. can not be used, because coking reactions at such temperatures greatly reduce oil yields.

The data obtained in Runs Nos. 7, 8 and 9 are summarized below in Table III. Included for reference purposes are the data for Run No. 3.

TABLE III

| Run No. | 7 | 8 | 3 | 9 |
|---|---|---|---|---|
| Reaction Tem- | | | | |

TABLE III-continued

| Run No. | 7 | 8 | 3 | 9 |
|---|---|---|---|---|
| perature, °C. | 399 | 399 | 399 | 399 |
| Time Required for Mixture to Reach Reaction Temperature, Minutes | 3–5 | 3–5 | 3–5 | 3–5 |
| Initial Pressure, Pounds Per Square Inch Gauge (MPa) | 300 (2.07) | 500 (3.45) | 750 (5.17) | 1000 (6.89) |
| Final Pressure, Pounds Per Square Inch Gauge (MPa) | 660 (4.55) | 750 (5.17) | 1100 (7.58) | 1200 (8.27) |
| Reaction Time, Minutes | 55 | 55 | 55 | 55 |
| Solvent/Shale Ratio (Gram/Gram) | 1.5:1 | 1.5:1 | 1.5:1 | 1.5:1 |
| Oil Yield, Percent Fischer Assay | 119 | 130 | 128 | 138 |

The effect of operating pressure upon the oil yield is apparent from the data in Table III. As the pressure is increased so is the oil yield. At a pressure of 1200 pounds per square inch gauge in Run No. 9 substantially complete extraction was obtained.

The data obtained in Runs Nos. 10 and 11 are summarized below in Table IV. Again, included therein for reference purposes are the data for Run No. 3.

TABLE IV

| Run No. | 3 | 10 | 11 |
|---|---|---|---|
| Reaction Temperature, °C. | 399 | 399 | 399 |
| Time Required for Mixture to Reach Reaction Temperature, Minutes | 3–5 | 3–5 | 3–5 |
| Initial Pressure, Pounds Per Square Inch Gauge (MPa) | 750 (5.17) | 750 (5.17) | 750 (5.17) |
| Final Pressure, Pounds Per Square Inch Gauge (MPa) | 1100 (7.58) | 900 (6.20) | 950 (6.55) |
| Reaction Time, Minutes | 55 | 55 | 55 |
| Solvent/Shale Ratio (Gram/Gram) | 1.5:1 | 1.0:1 | 0.75:1 |
| Oil Yield, Percent Fischer Assay | 128 | 89 | 75 |

The data in Table IV, as exemplified by Runs Nos. 10 and 11, show that when the solvent to shale weight ratio is below about 1.25:1 greatly inferior oil yields are obtained.

Data obtained in Run No. 12 are summarized below in Table V. Included therein for purposes of comparison are the data for Runs Nos. 3 and 8.

TABLE V

| Run No. | 3 | 12 | 8 |
|---|---|---|---|
| Reaction Temperature, °C. | 399 | 399 | 399 |
| Time Required for Mixture to Reach Reaction Temperature, Minutes | 3–5 | 55 | 3–5 |
| Initial Pressure, Pounds Per Square Inch Gauge (MPa) | 750 (5.17) | 750 (5.17) | 500 (3.45) |
| Final Pressure, Pounds Per Square Inch Gauge (MPa) | 1185 (8.16) | 1100 (7.58) | 750 (5.17) |
| Reaction Time, Minutes | 55 | 60 | 55 |
| Solvent/Shale Ratio (Gram/Gram) | 1.5:1 | 1.5:1 | 1.5:1 |
| Oil Yield, Percent Fischer Assay | 128 | 79 | 130 |

The data in Runs Nos. 3 and 8 show that when the reaction mixture containing oil shale and solvent was raised to a temperature level within the range of about 385° to about 440° C., as required herein, namely, 399° C., in a time period less than about 10 minutes, namely three to five minutes, excellent oil yields were obtained. However, when 55 minutes were employed in Run No. 12 to bring the reaction mixture to the defined temperature level, greatly decreased oil yields resulted.

The product oils obtained by this process differ from oils obtained by more traditional methods, such as retort processes, in that the oils of this process contain asphaltene and benzene insoluble components which are generally absent from oils obtained from prior art processes. Furthermore, the saturate components present in the oils obtained by this process contain less chain and more naphthenic structures than oils obtained by prior art processes.

Obviously, many modifications and variations of the invention, as hereinabove set forth, can be made without departing from the spirit and scope thereof, and therefore only such limitations should be imposed as are indicated in the appended claims.

I claim:

1. A process for recovering oil from oil shale containing kerogen which comprises bringing a mixture of oil shale and solvent to a temperature in the range of about 385° to about 440° C. in a time period of less than about 10 minutes, maintaining said mixture at a temperature in the range of about 385° to about 440° C. and a pressure in the range of about 250 to about 2000 pounds per square inch gauge for a period of about 20 minutes to about two hours and thereafter recovering the resulting oil.

2. The process of claim 1 wherein said mixture is brought to a temperature in the range of about 385° to about 440° C. in a time period of about two to about 10 minutes.

3. A process of claim 1 wherein said mixture is brought to a temperature in the range of about 400° to about 420° C. in a time period of about three to about five minutes.

4. The process of claim 1 wherein said mixture is maintained at a temperature in the range of about 400° to about 420° C. and a pressure in the range of about 500 to about 1200 pounds per square inch gauge for about 50 to about 80 minutes.

5. The process of claim 1 wherein the solvent to shale weight ratio is about 1.25:1 to about 4:1.

6. The process of claim 1 wherein the solvent to shale weight ratio is about 1.5:1 to about 2:1.

7. The process of claim 1 wherein said solvent is an organic solvent in which the resulting oil is soluble and which is liquid under reaction conditions.

8. The process of claim 7 wherein said organic solvent has a boiling point at ambient pressure of about 80° to about 400° C.

9. The process of claim 7 wherein said organic solvent has a boiling point at ambient pressure of about 200° to about 350° C.

10. The process of claim 1 wherein said solvent is tetralin.

11. The process of claim 1 wherein said shale has a mesh size of about 10 to about 400.

12. The process of claim 1 wherein said shale has a mesh size of about 20 to about 200.

13. The process of claim 1 wherein said shale has a mesh size of about 10 to about 400, the solvent to shale weight ratio is about 1.25:1 to about 4:1, the solvent is an organic solvent in which the resulting oil is soluble and which is liquid under reaction conditions, the solvent having a boiling point at ambient pressure of about 80° to about 400° C., said mixture is brought to a temperature in the range of about 385° to about 440° C. in a time period of about two to about ten minutes and said mixture is maintained at a temperature in the range of about 385° to about 440° C. and a pressure of about 250 to about 2000 pounds per square inch gauge for about 20 minutes to about two hours.

14. The process of claim 1 wherein said shale has a mesh size of about 20 to about 200, the solvent to shale weight ratio is about 1.5:1 to about 2:1, the solvent is an organic solvent in which the resulting oil is soluble and which is liquid under reaction conditions, the solvent having a boiling point at ambient pressure of about 200° to about 350° C., said mixture is brought to a temperature in the range of about 400° to about 420° C. in a time period of about three to about five minutes and said mixture is maintained at a temperature in the range of about 400° to about 420° C. and a pressure of about 500 to about 1200 pounds per square inch gauge for about 50 to about 80 minutes.

* * * * *